US010755881B2

(12) United States Patent
Thron et al.

(10) Patent No.: US 10,755,881 B2
(45) Date of Patent: Aug. 25, 2020

(54) CIRCUIT ARRANGEMENT FOR OPERATING ELECTROMAGNETIC DRIVE SYSTEMS

(71) Applicants: Knorr-Bremse Powertech GmbH, Berlin (DE); Ellenberger & Poensgen GmbH, Altdorf bei Nürnberg (DE)

(72) Inventors: Burkhard Thron, Königs Wusterhausen (DE); Olaf Laske, Berlin (DE); Michael Naumann, Feucht (DE)

(73) Assignees: KNORR-BREMSE POWERTECH GMBH, Berlin (DE); ELLENBERGER & POENSGEN GMBH, Altdorf Bei Nurnberg (DE)

( * ) Notice: Subject to any disclaimer, the term of this patent is extended or adjusted under 35 U.S.C. 154(b) by 262 days.

(21) Appl. No.: 15/780,833

(22) PCT Filed: Dec. 5, 2016

(86) PCT No.: PCT/EP2016/079706
§ 371 (c)(1),
(2) Date: Jun. 1, 2018

(87) PCT Pub. No.: WO2017/093552
PCT Pub. Date: Jun. 8, 2017

(65) Prior Publication Data

US 2018/0366288 A1 Dec. 20, 2018

(30) Foreign Application Priority Data

Dec. 4, 2015 (DE) ..... 10 2015 015 580

(51) Int. Cl.
*H01H 47/04* (2006.01)
*H01H 47/10* (2006.01)
(Continued)

(52) U.S. Cl.
CPC ..... *H01H 47/325* (2013.01); *H01F 7/06* (2013.01); *H01H 47/002* (2013.01); *H01H 47/04* (2013.01); *H01H 47/10* (2013.01)

(58) Field of Classification Search
CPC ..... H01H 7/04; H01H 7/10
(Continued)

(56) References Cited

U.S. PATENT DOCUMENTS 4,859,921 A * 8/1989 Archer ..... H02M 7/5387 318/599
8,472,216 B2 * 6/2013 Busch ..... H02J 9/005 363/50

FOREIGN PATENT DOCUMENTS

DE 19744202 A1 4/1999
DE 19851973 A1 4/2000
(Continued)

OTHER PUBLICATIONS

ISA European Patent Office, International Search Report Issued in Application No. PCT/EP2016/079706, dated Feb. 15, 2017, WIPO, 4 pages.

*Primary Examiner* — Gary A Nash
(74) *Attorney, Agent, or Firm* — McCoy Russell LLP

(57) ABSTRACT

An example circuit arrangement and method for actuating an electromagnetic drive system for electromechanical devices is disclosed, the example circuit arrangement including a mechanically locked end position, a control voltage source, a regulating and control circuit, a drive system, a transformer, a rectifier bridge a smoothing capacitor, and a main switching transistor, by means of which the drive system can be controlled in a characteristic pulse tracking system. In the example, the main switching transistor is connected in series to a primary branch of the transformer, the transformer is connected to the supply voltage, and the secondary winding of the transformer supplies the rectifier bridge, the output
(Continued)

DC voltage of which is smoothed by the smoothing capacitor and added to the voltage of the control voltage source so as to result in a DC voltage feed having a chronological supply progression.

11 Claims, 2 Drawing Sheets

(51) Int. Cl.
*H01H 47/32* (2006.01)
*H01F 7/06* (2006.01)
*H01H 47/00* (2006.01)

(58) Field of Classification Search
USPC ..... 361/153, 154; 363/21.13, 21.18
See application file for complete search history.

(56) References Cited

FOREIGN PATENT DOCUMENTS

| | | | |
|---|---|---|---|
| DE | 202011051972 | U1 | 1/2012 |
| FR | 2803956 | A1 | 7/2001 |
| JP | 3062707 | B2 | 7/2000 |

* cited by examiner

CIRCUIT ARRANGEMENT FOR OPERATING ELECTROMAGNETIC DRIVE SYSTEMS

CROSS-REFERENCE TO RELATED APPLICATIONS

The present application is a U.S. National Phase of International Patent Application Serial No. PCT/EP2016/079706 entitled "CIRCUIT ARRANGEMENT FOR OPERATING ELECTROMAGNETIC DRIVE SYSTEMS," filed on Dec. 5, 2016. International Patent Application Serial No. PCT/EP2016/079706 claims priority to German Patent Application No. 10 2015 015 580.6, filed on Dec. 4, 2015. The entire contents of each of the above-cited applications are hereby incorporated by reference in their entirety for all purposes.

TECHNICAL FIELD

The present invention relates to a circuit arrangement for actuating an electromagnetic drive system for electromechanical devices as well as a method for operating a circuit arrangement for actuating an electromagnetic drive system for electromechanical devices.

BACKGROUND

Electromagnetic drive systems are often used in electrical engineering to apply force on movable mechanical components. Such systems use for example pull magnets or other electromagnetically operative component assemblies. These drive systems are used inter alia in contactors, circuit breakers, relays, solenoid valves, etc. in various forms.

In the actuating of such drive systems, the magnetic system is usually directly energized by the control voltage source; an acceleration of mechanical components thereby occurs such as e.g. armature or lever systems. That causes, for example, the closing of switch contacts. However, the force curve and closing speed in this case depend on the amount of voltage applied.

Yet it is also known that the energy supply of drive systems is often controlled by electronic assemblies (ballasts) such that the displacement/time characteristic of the force curve optimally corresponds to the requirements of the mechanical system during actuation Already known from DE 20 2011 051 972 U1 is a circuit arrangement for actuating a switching device which exhibits a first switch position and a second switch position and can be switched between the first switch position and the second switch position and comprises at least one electromagnetic actuating device for generating a actuating force for switching the switching device between the first switch position and the second switch position and a trigger circuit for actuating the electromagnetic actuating device.

The actuation of the aforementioned drive systems by directly loading the magnetic systems with the available control voltage has the disadvantage of the supplied control current and thus the magnetic force usually not being adapted to the existing force/displacement characteristic of the powered mechanical system.

The known electronic ballasts for operating magnetic drive systems directly clock the magnetic systems via one or more electronic switches. Thereby disadvantageous is that while the available control voltage can be reduced, it cannot be increased.

Yet it is advantageous in a number of applications of said drive systems to also be able to increase the actuation control voltage if needed. Otherwise in such applications—for example in undervoltage situations—safe actuation is not possible.

Furthermore, these ballasts preferably serve in the actuating of switching devices in the form of in contactors in which the power requirement is initially high but which then drops over time.

The direct clocking of the electrical drive system additionally results in an interference voltage spectrum which can negatively affect other electronic systems. The pulse gradient also causes an increased loading of the coil structure of the magnetic systems which are mostly designed for DC or low-frequency AC operation. The clocked mode of operation can thus cause damage to the winding of the magnetic system.

It is therefore the task of the present invention to further advantageously develop a circuit arrangement and a method for operating a circuit arrangement, in particular to the effect of ensuring reliable and less mechanically aggressive operation without substantial emitted interference across the entire input voltage and temperature range and enabling the actuating of such drive systems having a greatly increasing power requirement over time during actuation as well as a mechanically locked stable end position.

The invention solves this task by a circuit arrangement having the features of claim 1. According thereto, a circuit arrangement is provided for the actuating of an electromagnetic drive system for electromechanical devices, in particular comprising a mechanically locked end position, at least one control voltage source, at least one regulating and control circuit, at least one drive system, at least one transformer, at least one rectifier bridge, at least one smoothing capacitor, at least one main switching transistor, by means of which the drive system can be controlled in a characteristic pulse tracking system and wherein the main switching transistor is connected in series to a primary branch of the transformer, wherein the transformer is connected to the supply voltage and the secondary winding of the transformer supplies the rectifier bridge, the output DC voltage of which is smoothed by the smoothing capacitor and added to the voltage of the control voltage source so as to result in a DC voltage feed having a chronological supply progression.

The invention is based on the basic concept of a clocked transformational converter stage providing the electrical supply characteristic required for the specific operation of the electromagnetic drive system throughout the entire input voltage and temperature range without pulsed loading of the drive system coils by way of a control and regulating circuit. The disadvantages of the known control systems identified in the prior art are avoided and a circuit arrangement is provided which operates the magnetic system of said drive systems, in particular those with DC solenoid coils, such that reliable and less mechanically aggressive operation without substantial emitted interference is ensured throughout the entire input voltage and temperature range and also allows the actuating of such drive systems having a greatly increasing power requirement over time during actuation as well as a mechanically locked stable end position.

The operation of switching devices having electromagnetic drive systems, for example battery circuit breakers having drive system pull magnets and a mechanically locked end position, contactor and relay coils as well as solenoid valves with electromagnetic valve control, gives rise to limited operating voltage ranges and increased wear of the mechanically moved components due to the internal structure. Clocked voltage operation gives rise to emitted interference which can affect electronic circuits.

To avoid these disadvantages, a circuit arrangement is now inventively provided which supplies a regulated DC voltage having a beneficial supply progression for the drive system by means of a switching stage and transformer arrangement with a downstream rectifier and also enables the actuating voltage to be increased over the existing and possibly highly tolerance-dependent control voltage when needed. This thereby ensures their safe activation, as in the example case of a battery circuit breaker having drive system pull magnets and a battery-backed power supply system subject to a wide input voltage range. The circuit arrangement moreover enables a delicate and thus life-extending mode of operation for the mechanically moved components. Feeding DC voltage to the drive system largely prevents emitted interference, particularly in the case of longer wirings between the described circuit arrangement and the drive system.

An auxiliary diode connected to the transformer/main switching transistor node on the anode side and to the rectifier bridge cathodes node on the cathode side can be provided.

The rectifier bridge can be formed by a plurality of diodes. These diodes can, for example, be fast diodes for output rectification.

It can furthermore be provided for a second transistor to be furnished and for the switching arrangement to be switchable such that a hold circuit can be activated in the power circuit by means of a second transistor using the return magnetization energy of the transformer for the activation time via the processing of a gate voltage, whereby the second transistor is activated and is disabled after the activation time by the switching off of the main switching transistor and the ceasing of the return magnetization energy.

It is moreover possible for the control and regulating circuit to comprise a PWM circuit (PWM=pulse width modulation) with activation time limitation and for a pulse pattern corresponding to the specifics of the drive system able to be assigned to the respective application by an appropriate selection to be stored via the PWM circuit.

It can furthermore be provided for the circuit arrangement to comprise a microcontroller circuit and for the microcontroller circuit to be used for the coordinated control and pulse processing.

Additionally possible is for a thermal fuse, in particular a reversible thermal fuse, and a series resistor for the control current supply to be arranged such that in the event of failure in the main current path, the combination of thermal fuse and series resistor can be arranged and switched such that the main current path is interruptible via the thermal coupling of the thermal fuse and series resistor.

It can furthermore be provided for the circuit arrangement to further comprise a safety circuit having an optocoupler and a Z-diode which can be switched such that in the event the output load is interrupted, inadmissibly high output voltage can thereby be prevented by the safety circuit responding in the event of failure such that the optocoupler is activated by the excessive output voltage via the Z-diode and the output of the optocoupler thereby acts on the control and regulating circuit, with the activation period thus being reduced for the power transistor such that the output voltage remains restricted to a permissible level.

The present invention further relates to a method for operating a circuit arrangement.

In one method of operating a circuit arrangement for the actuating of an electromagnetic drive system for electromechanical devices, in particular comprising a mechanically locked end position, at least one control voltage source, at least one regulating and control circuit, at least one drive system, at least one transformer, at least one rectifier bridge, at least one smoothing capacitor, at least one main switching transistor, by means of which the drive system can be controlled in a characteristic pulse tracking system in at least one operating state and wherein the main switching transistor is connected in series to a primary branch of the transformer, the process is thereby for the transformer to be connected to the supply voltage and the secondary winding of the transformer to supply the rectifier bridge, the output DC voltage of which is smoothed by the smoothing capacitor and added to the voltage of the control voltage source so as to result in a DC voltage feed having a chronological supply progression.

It can furthermore be provided for a second transistor to be furnished and for the switching arrangement to be switched during operation such that a hold circuit can be activated in the power circuit by means of a second transistor using the return magnetization energy of the transformer for the activation time via the processing of a gate voltage, whereby a second transistor is activated and is disabled after the activation time by the switching off of the main switching transistor and the ceasing of the return magnetization energy.

It is moreover possible for the regulating and control circuit to comprise a PWM circuit with activation time limitation and for a pulse pattern corresponding to the specifics of the drive system able to be assigned to the respective application by an appropriate selection to be stored via the PWM circuit.

Additionally possible is for a thermal fuse, in particular a reversible thermal fuse, and a series resistor for the control current supply to be arranged such that in the event of failure in the main current path, the thermal fuse and series resistor combination can be switched such that the main current path is interrupted via the thermal coupling of the thermal fuse and series resistor.

It can additionally be provided for the circuit arrangement to further comprise a safety circuit having an optocoupler and a Z-diode which can be switched in the event of failure such that if the output load is interrupted, inadmissibly high output voltage can thereby be prevented by the safety circuit responding in the event of failure such that the optocoupler is activated by the excessive output voltage via the Z-diode and the output of the optocoupler thereby acts on the control and regulating circuit, with the activation period thus being reduced for the power transistor such that the output voltage remains restricted to a permissible level.

BRIEF DESCRIPTION OF THE FIGURES

Further specifics and advantages of the invention will now be described in greater detail on the basis of an example embodiment depicted in the drawings.

Shown are.

DETAILED DESCRIPTION OF FIGURES

Figure 1:
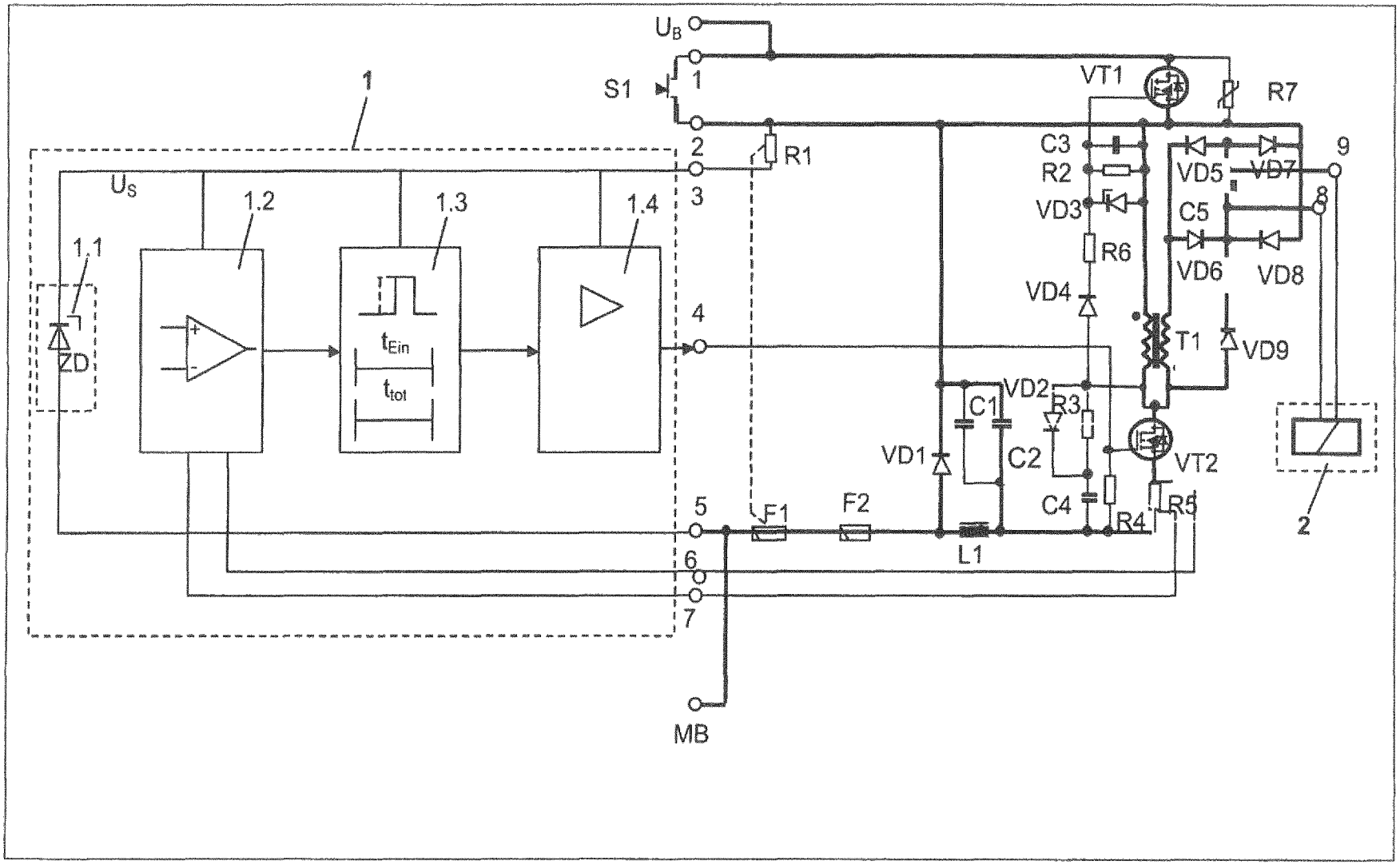
FIG. 1 a schematic circuit diagram for one example embodiment of a circuit arrangement for actuating an electromagnetic drive system as well as a corresponding method thereto.

FIG. 1 shows a schematic circuit diagram of an example embodiment of a circuit arrangement, realized here as a battery circuit breaker having a pull magnet, its circuit and operating principle illustrated in FIG. 1 as well as described in greater detail below.

The circuit arrangement comprises a regulating and control circuit 1 which in detail comprises a stabilizer circuit for the internal control voltage $U_S$ with ZD 1.1, a measured value detection 1.2, a PWM circuit (pulse width modulation circuit) with activation time limitation t 1.3 as well as a driver circuit 1.4 for the power switch (VT2).

In addition, the switching arrangement comprises an electromagnetic drive system 2.

The switching arrangement is connected to a control voltage source with an operating voltage ($U_B$).

The MB reference symbol indicates the negative potential (main current).

The switching arrangement moreover comprises a power button S1, a series resistor R1 for the current supply $U_S$, a gate bleeder resistor R2 for the switching transistor VT1, a discharge resistor R3 in the snubber circuit for the power transistor for the self-holding circuit VT2, a gate bleeder resistor R4 for the power transistor VT2 as well as a standing resistor R5 for detecting the main current for the generating of the control variable. Further provided are a current limiting resistor R6, an overvoltage protector R7, a low-inductance intermediate circuit capacitor C1, an intermediate circuit capacitor C2 of higher storage capacity, a smoothing capacitor C3, a capacitor C4 of the DRC snubber circuit for the power transistor VT2, and a smoothing capacitor C5 for the output load. The switching arrangement VD1 additionally comprises a reverse pole diode and freewheeling diode VD1, a fast diode VD2 of the DRC circuit for the power transistor VT2, a gate voltage limitation VD3, a fast rectifier diode VD4 for the processing of the gate voltage for the switching transistor VT1, fast diodes for output rectification VD5, VD6, VD7 and VD8 as well as a freewheeling diode VD9 for the switching transistor VT1, an input choke L1 (inrush current limitation), a thermal fuse F1 as well as an overcurrent protector F2.

An auxiliary diode connected to the transformer T1/switching transistor VT2 node on the anode side and to the node comprised of the cathodes VD6, VD8 of the rectifier bridge, formed by diodes VD5, VD6, VD7, VD8, on the cathode side.

Furthermore provided are terminals 1/2, representing the power button connections, one terminal 3 as supply input for the control current supply, one terminal 4 for the connection of the switching transistor VT1 activation, one terminal 5 as negative potential of the control voltage level, terminals 6/7 as shunt voltage supply for the regulating circuit with measuring field detection 1.2, and terminals 8/9 as connection for the output load 2 of the electromagnetic drive system 2.

The $t_{Ein}$ reference symbol indicates the activation time and the $t_{tot}$ reference symbol indicates the dead time.

The functionality of the control arrangement and the inventive method will now be explained as below:

When activated, the battery circuit breaker reaches a mechanically locked stable end position. The function of safely energizing pull magnets and reliably achieving the mechanically fixed end position of the battery circuit breaker must be ensured in a voltage range of from 65V to 150V, whereby the rated control voltage amounts to 110V.

In this application, the proposed arrangement must ensure that despite greatly increasing power requirement—as opposed to the commonly known contactors—sufficient energy needs to be provided for the magnetic system at the end of the actuation period.

The activation process is started via the start button S1 so that the transistor VT1 in the off state is bridged and the regulating and control circuit activated via the series resistor R1; the control voltage processing 1.1 is symbolized by ZD. To establish the pulse pattern, a pulse-width modulated signal at a constant base frequency of 40 kHz is generated.

Figure 2:
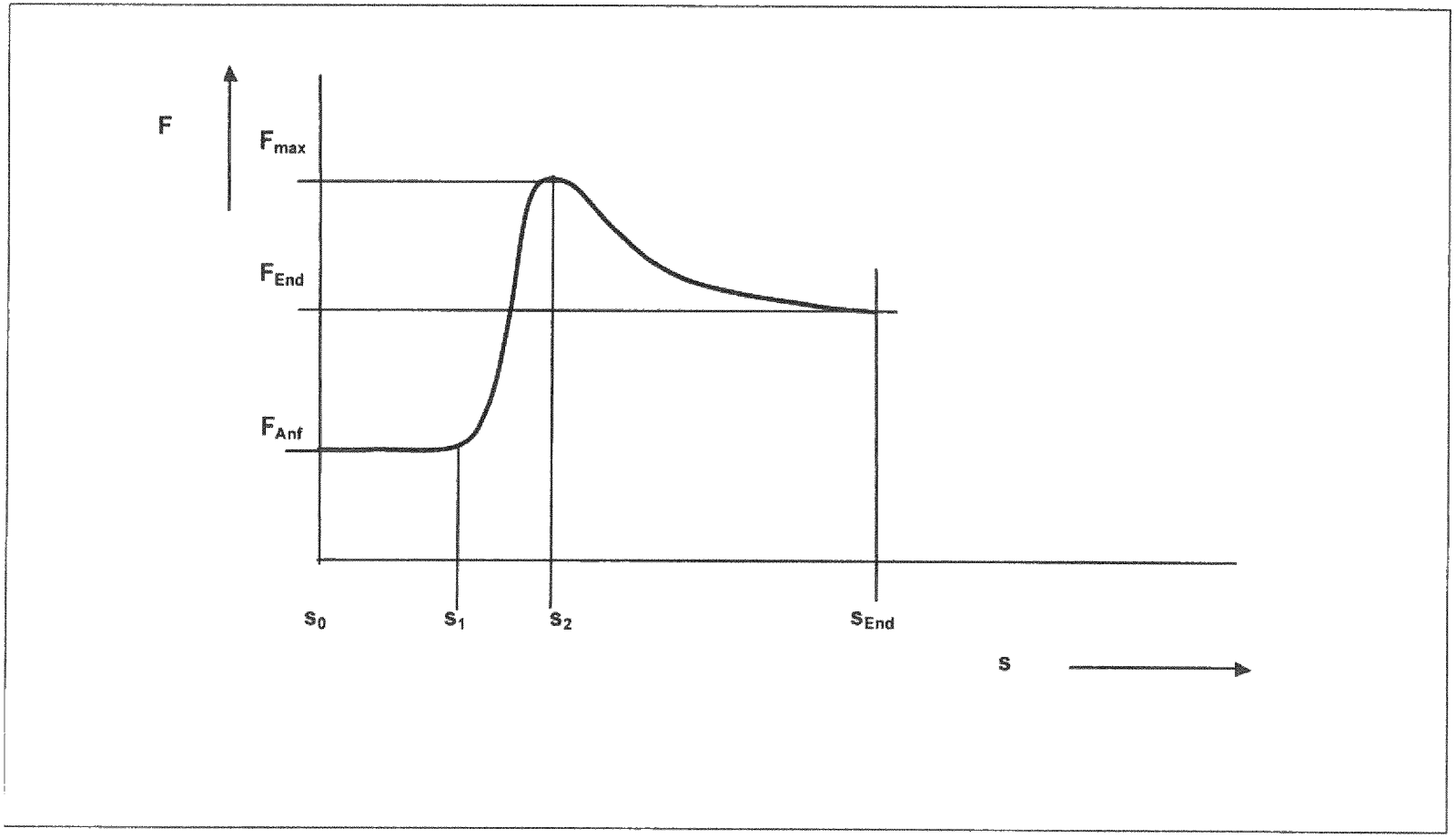
FIG. 2 the quantitative progression of the force/displacement characteristic of the power mechanism of the switching arrangement according to FIG. 1.

The activation time $t_{Ein}$ is calculated such that the required pick-up time in consideration of the permissible pull magnet operating period is maintained under all environmental conditions, as depicted in FIG. 2.

The pull magnets 2 are designed for short-term operation; inadmissibly long periods of operation lead to damage. Should the permissible operating period be exceeded in the event of a failure, the thermal fuse F1 is activated due to the thermal coupling with resistor R1. Series resistor R1 and the reversible thermal fuse have the same basic casing design (TO220) and are mechanically connected at the thermal contact surfaces of the casings so as to ensure safe and defined activation in the event of failure. The selecting of the resistor size results in approximately thermally equivalent behavior to the pull magnets 2.

The transistor VT2 is activated by the regulating and control circuit 1 within the time $t_{Ein}$ of 1.6 s of the PWM circuit, a voltage generated by the rectifier bridge of VD5 to VD8 and smoothed by C5 corresponding to the transmission ratio of the transformer T1 is thereby added to the control (input) voltage $U_B$. This arrangement achieves the voltage at the pull magnets being able to be brought to a value both below and above the control voltage by varying the PWM duty cycle. Switch S1 can be reopened after being closed; the self-holding circuit with VT1 further powers the circuit by supplying the return magnetization voltage of T1 via diode VD4, the current limiting resistor R6 of the limiting and stabilizer circuit with VD3, R2 and C3 to the gate by VT1 so that it is activated. As long as the stage is clocking with VT2, the power circuit remains activated via VT1. After time $t_{Ein}$ has elapsed, the stage with VT2 is deactivated, the power circuit is interrupted. After a dead time $t_{tot}$ has elapsed, the switching operation can be restarted. The dead time $t_{tot}$ prevents the drive system coils from being overloaded due to improper use.

The internal control voltage processing 1.1 moreover ensures with its own time stage that stabilizer ZD is not overloaded due to improper actuation of power button S1 (uninterrupted keying); in such a case, 1.1 is forcibly deactivated after a predefined period of time which is longer than the normal operating time of the device.

Capacitors C1 and C2 are provided to sufficiently decouple the inherent resistances of supply source $U_B$, whereby low-inductance capacitor C1 feed in the activation moment of VT2 and moreover the AC portion of the intermediate circuit capacitor C2 with the substantially higher capacity and higher internal resistance takes over.

The choke L1 is provided for the inrush current limitation and the power discharge from switch S1.

The circuit is equipped with a current control; the main current is detected in the power circuit and fed to the measured value detection 1.2 via the shunt resistor R5. The measured value detection 1.2 provides the signals for the control and regulating circuit 1.3 which processes the pulse-width pattern according to the specific characteristic of the electromagnetic drive system 2. A series of specific supply characteristics can be stored in the control and regulating circuit 1.3 which can be appropriately selected and thus correspond to the respective intended application.

If there should be no connection of the output terminals 8, 9 to circuit breaker 2 due to an error during use, the output voltage is limited by the control and regulating circuit 1.3.

As is evident from FIG. 2, Lite force/displacement characteristic is such that upon the switching device 2 switching from a first switching position so corresponding to one of the open positions into a second switching position $s_{End}$ corresponding to the closed position over displacement path s, a comparatively low initial force $F_{Anf}$ is initially required which then increases to a maximum force $F_{max}$ as of a pressure point $s_2$ up to a maximum point $S_2$ and, subsequent the maximum point $s_2$, drops to a final force $F_{End}$ until the second switching position $s_{End}$. The actuating force F on the pull magnets ZM1, ZM2 is generated according to the curve of this force/displacement characteristic so that the actuating force F of the force/displacement characteristic of the switching device 2 is adjusted.

Adapting the actuating force F to the force/displacement characteristic of the switching device 2 ensures a less mechanically aggressive operation of the switching device 2. In particular, excessive actuating force F is prevented which could lead to wear or even damage of the switching device 2 upon striking mechanically actuated components.

In addition, adapting the actuating force F to the force/displacement characteristic of the switching device 2 ensures reliable switching of the switching device 2 independent of the specific control voltage $U_{Dauer}$ available. In particular, modifying the control voltage $U_{Dauer}$ in the intermediate circuit voltage $U_{ZK}$ and adapting the actuating force F to the force/displacement characteristic of the switching device 2 over the entire voltage range of the control voltage $U_{Dauer}$ ensures that there will be sufficient energy to switch the switching device 2 and moreover excludes a bouncing of mechanically actuated components of the switching device 2.

LIST OF REFERENCE NUMERALS

1—regulating and control circuit
1.1—stabilizer circuit for internal control voltage $U_S$ with ZD
1.2—measured value detection
1.3—PWM circuit with activation time limitation t
1.4—driver circuit for power switch (VT2)
2—electromagnetic drive system
$U_B$—operating voltage
MB—negative potential (main current)
S1—power button
R1—series resistor for control current supply $U_S$
R2—gate bleeder resistor for VT1
R3—discharge resistor in snubber circuit of VT2
R4—gate bleeder resistor for VT2
R5—shunt resistor for detecting the main current to generate the control variable
R6—current limiting resistor
R7—overvoltage protector
C1—low-inductance intermediate circuit capacitor
C2—intermediate circuit capacitor of higher storage capacity
C3—smoothing capacitor
C4—capacitor of DRC snubber circuit for VT2
C5—smoothing capacitor for output load
VD1—reverse pole diode and freewheeling diode
VD2—fast diode of DRC circuit for VT2
VD3—gate voltage limitation
VD4—fast rectifier diode for processing the gate voltage for VT1
VD5 to VD8—fast diodes for output rectification
VD9—freewheeling diode for T1
VT1—switching transistor
VT2 power transistor for self-holding circuit
L1—input choke (inrush current limitation)
F1—thermal fuse
F2—overcurrent protector
Terminals: 1/2 connections for power button
3 supply input for control current supply
4 connection for activating VT1
5 negative potential (control voltage level)
6/7 shunt voltage supply for the regulating circuit with 1.2
8/9 connection for output load 2
$t_{Ein}$ activation time
$t_{tot}$ dead time
F actuating force
$F_{Anf}$ actuating force at moment of activation
$F_{max}$ actuating force at pressure point
$F_{End}$ actuating force at end of displacement path
s armature path of pull magnet
$s_0$ deactivation position
$s_1$ distance between deactivation position and pressure point
$s_2$ distance between deactivation position and required maximum force
$s_{End}$ distance between deactivation and final position

The invention claimed is:

1. A circuit arrangement for actuating an electromagnetic drive system for electromechanical devices, comprising:
a mechanically locked end position,
at least one control voltage source,
at least one regulating and control circuit,
at least one drive system,
at least one transformer,
at least one rectifier bridge,
at least one smoothing capacitor,
at least one main switching transistor, wherein the drive system is controllable in a characteristic pulse tracking system, wherein the main switching transistor is connected in series to a primary branch of the transformer, wherein the transformer is connected to the supply voltage, and wherein the secondary winding of the transformer supplies the rectifier bridge, the output DC voltage of which is smoothed by the smoothing capacitor and added to the voltage of the control voltage source so as to result in a DC voltage feed having a chronological supply progression.

2. The circuit arrangement according to claim 1, wherein a second transistor is provided and the switching arrangement is switchable such that a hold circuit can be activated in the power circuit by a second transistor using return magnetization energy of the transformer T1 for an activation time via processing of a gate voltage, wherein the second transistor is activated and is disabled after the activation time by a switching off of the main switching transistor and a ceasing of the return magnetization energy.

3. The circuit arrangement according to claim 1, wherein the regulating and control circuit comprises a PWM circuit with activation time limitation and a pulse pattern corresponding to the specifics of the drive system is able to be assigned to the respective application by an appropriate selection is stored via the PWM circuit.

4. The circuit arrangement according to claim 1, wherein the circuit arrangement further comprises a microcontroller circuit and the microcontroller circuit is used for coordinated control and pulse processing.

5. The circuit arrangement according to claim 1, wherein a thermal fuse, including a reversible thermal fuse, and a series resistor for the control current supply is are arranged such that in an event of failure in a main current path, the combination of thermal fuse and the series resistor is arranged and switchable such that the main current path is interruptible via a thermal coupling of the thermal fuse and the series resistor.

6. The circuit arrangement according to claim 1, wherein the circuit arrangement further comprises a safety circuit having an optocoupler and a Z-diode which can be switched such that in an event an output load is interrupted, an inadmissibly high output voltage can be prevented by the safety circuit responding such that the optocoupler is activated by an excessive output voltage via the Z-diode in an event of failure and an output of the optocoupler thereby acts on the control and regulating circuit and an activation period is thus reduced for the power transistor such that the output voltage remains restricted to a permissible level.

7. A method for operating a circuit arrangement for actuating an electromagnetic drive system for electromechanical devices, the circuit arrangement comprising a mechanically locked end position, at least one control voltage source, at least one regulating and control circuit, at least one drive system, at least one transformer, at least one rectifier bridge, at least one smoothing capacitor, and at least one main switching transistor, the method comprising operating the circuit arrangement, wherein the drive system is controlled in a characteristic pulse tracking system in at least one operating state and wherein the main switching transistor is connected in series to a primary branch of the transformer, wherein the transformer is connected to the supply voltage and the secondary winding of the transformer supplies the rectifier bridge, the output DC voltage of which is smoothed by the smoothing capacitor and added to the voltage of the control voltage source so as to result in a DC voltage feed having a chronological supply progression.

8. The method according to claim 7, wherein a second transistor is provided and the switching arrangement is switched during operation such that a hold circuit is activated in the power circuit by the second transistor using return magnetization energy of the transformer for an activation time via processing of a gate voltage, wherein the second transistor is activated and is disabled after the activation time by switching off the main switching transistor and ceasing the return magnetization energy.

9. The method according to claim 7, wherein the regulating and control circuit comprises a PWM circuit with activation time limitation and a pulse pattern corresponding to the specifics of the drive system that is able to be assigned to the respective application by an appropriate selection is stored via the PWM circuit.

10. The method according to claim 7, wherein a thermal fuse, including a reversible thermal fuse, and a series resistor for the control current supply is are arranged such that in the event of failure in the main current path, a combination of the thermal fuse and the series resistor is switched such that the main current path is interrupted via the thermal coupling of the thermal fuse and the series resistor.

11. The method according to claim 7, wherein the circuit arrangement further comprises a safety circuit having an optocoupler and a Z-diode which can be switched in the event of failure such that if an output load is interrupted, an inadmissibly high output voltage can thereby be prevented by the safety circuit responding such that the optocoupler is activated by an excessive output voltage via the Z-diode in an event of failure and an output of the optocoupler thereby acts on the control and regulating circuit and an activation period is thus reduced for the power transistor such that the output voltage remains restricted to a permissible level.

* * * * *